US007511251B2

(12) United States Patent
Baek et al.

(10) Patent No.: US 7,511,251 B2
(45) Date of Patent: Mar. 31, 2009

(54) MAGNETRON HAVING CHOKE FILTER CONFIGURED TO INTERCEPT EXTERNAL LEAKAGE

(75) Inventors: Seung-Won Baek, Seoul (KR); Jong-Soo Lee, Anyang (KR)

(73) Assignee: LG Electronics Inc., Seoul (KR)

( * ) Notice: Subject to any disclaimer, the term of this patent is extended or adjusted under 35 U.S.C. 154(b) by 33 days.

(21) Appl. No.: 11/613,531

(22) Filed: Dec. 20, 2006

(65) Prior Publication Data

US 2007/0139125 A1 Jun. 21, 2007

(30) Foreign Application Priority Data

Dec. 21, 2005 (KR) ..... 10-2005-0127263

(51) Int. Cl.
*H05B 6/76* (2006.01)
*H01J 25/50* (2006.01)

(52) U.S. Cl. ..... 219/737; 219/738; 219/736; 219/741; 219/757; 315/39.77; 315/39.75; 315/39.65

(58) Field of Classification Search ..... 219/737, 219/738, 736, 741, 757, 531, 526, 540, 541, 219/552, 553, 482, 481, 496; 315/39.77, 315/39.75, 39.65
See application file for complete search history.

(56) References Cited

U.S. PATENT DOCUMENTS 4,459,563 A * 7/1984 Kawaguchi ..... 331/91
6,097,154 A * 8/2000 Choi ..... 315/39.51
6,437,511 B1 8/2002 Choi
7,148,627 B2 12/2006 Ishii et al.
2004/0021422 A1 2/2004 Ishii et al.
2007/0145899 A1 * 6/2007 Baek et al. ..... 315/39.51

FOREIGN PATENT DOCUMENTS

CN 1202720 A 12/1998
CN 1472767 A 2/2004
KR 1999-010070 2/1999

OTHER PUBLICATIONS

U.S. Appl. No. 11/611,523 to Lee, filed Dec. 15, 2006.
U.S. Appl. No. 11/615,405 to Baek et al., filed Dec. 22, 2006.
English Language Abstract of KR 1999-010070.
English language Abstract of CN 1202720 A (Dec. 23, 1998).
English language Abstract of CN 1472767 A (Feb. 4, 2004).

* cited by examiner

*Primary Examiner*—Tuyet Vo
(74) *Attorney, Agent, or Firm*—Greenblum & Bernstein, P.L.C.

(57) ABSTRACT

A magnetron is provided including a yoke having an internal space, a first magnet provided at one end of the internal space, a second magnet provided at a second end of the internal space, the second magnet being axially spaced from the first magnet. Further, an anode cylinder that generates radio frequency energy may be provided axially between the first and second magnets, a first pole piece and a second pole piece may be provided proximate first and second openings of the anode cylinder, respectively. Additionally, the magnetron may also include a seal that intercepts external leakage, the seal may have an inward protrusion extending axially towards the anode cylinder; and a choke filter that intercepts external leakage provided proximate the seal.

19 Claims, 6 Drawing Sheets

MAGNETRON HAVING CHOKE FILTER CONFIGURED TO INTERCEPT EXTERNAL LEAKAGE

RELATED APPLICATION

The present disclosure relates to subject matter contained in priority Korean Application No. 10-2005-0127263, filed on Dec. 21, 2005, which is herein expressly incorporated by reference in its entirety.

BACKGROUND OF THE INVENTION

1. Field of the Invention

The present invention relates to a magnetron, and more particularly, to a magnetron which can simplify an installation process of the choke filter and cut down the manufacturing cost of the choke filter.

2. Description of the Background Art

In general, a magnetron is a bipolar vacuum tube consisting of a cylindrical cathode (straight wire) and a coaxial anode, and generating an electric field by impressing a DC voltage between the cathode and the anode. In a state where a magnetic field is impressed in the length direction of the magnetron by using an external magnet, when the magnetron is connected to a resonance circuit, the magnetron is operated as an oscillator. The magnetron generates a very high frequency or a large output in a short time. Therefore, the magnetron can be used as a main power source of a radar system or a microwave oven.

Conversely, since the magnetron generates a very high frequency and a large output in a short time, if the radio frequency generated by the magnetron is externally leaked, the radio frequency has the detrimental effects on the human body or peripheral electronic devices, thereby causing noise.

Recently, the interception of the external leakage of the radio frequency generated by the magnetron has been researched. The present invention also relates to the interception of the external leakage of the radio frequency generated by the magnetron.

SUMMARY OF THE INVENTION

To achieve these and other advantages and in accordance with the purpose of the present invention, as embodied and broadly described herein, there is provided a magnetron, including a yoke having a predetermined internal space by coupling an upper yoke to a lower yoke (e.g., first and second ends of the yoke); an upper (or first) magnet and a lower (or second) magnet housed (or provided) in the internal space, and fixedly coupled respectively to the inner flat surfaces of the upper yoke and the lower yoke along the width direction of the yoke; an anode cylinder disposed in a space between the upper magnet and the lower magnet, for generating radio frequency energy; a funnel-shaped upper (or first) pole piece and a funnel-shaped lower (or second) pole piece disposed at the upper and lower opening units (e.g., first and second openings) of the anode cylinder, respectively; a cylindrical A-seal disposed at the upper portion of the upper pole piece, for intercepting external leakage of a fifth harmonic; and the choke filter having a planar disk bonded to the inner circumferential surface of the A-seal, for intercepting external leakage of a third harmonic.

The foregoing and other objects, features, aspects and advantages of the present invention will become more apparent from the following detailed description of the present invention when taken in conjunction with the accompanying drawings.

BRIEF DESCRIPTION OF THE DRAWINGS

The present invention is further described in the detail description which follows, in reference to the noted plurality of drawings, by way of non-limiting examples of preferred embodiments of the present invention, in which like characters represent like elements throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Reference will now be made in detail to the preferred embodiments of the present invention, examples of which are illustrated in the accompanying drawings.

The present invention provides a magnetron, including a yoke having a predetermined internal space, e.g., formed by coupling an upper (or first) yoke to a lower (or second) yoke; an upper (or first) magnet and a lower (or second) magnet housed in the internal space. Further, the upper and lower magnets may be fixedly coupled to inner flat surfaces of the upper yoke and the lower yoke, respectively, along the width direction of the yoke. Additionally, an anode cylinder disposed in a space between the upper magnet and the lower magnet, for generating radio frequency energy; a funnel-shaped upper (or first) pole piece and a funnel-shaped lower (or second) pole piece disposed at the upper and lower opening units (e.g., first and second openings) of the anode cylinder, respectively; a cylindrical A-seal disposed at the upper portion of the upper pole piece, for intercepting external leakage of a fifth harmonic; and the choke filter having a planar disk bonded to an inner circumferential surface of the A-seal, for intercepting external leakage of a third harmonic. That is, the coupling slot may be formed by cutting one side of the disk such that one side flat surface of the disk is not bonded to the a seal. For example, the coupling slot may be formed by cutting one side of the disk such that a generally flat edge of the disk is spaced from an inner circumferential surface of the A-seal.

Figure 1:
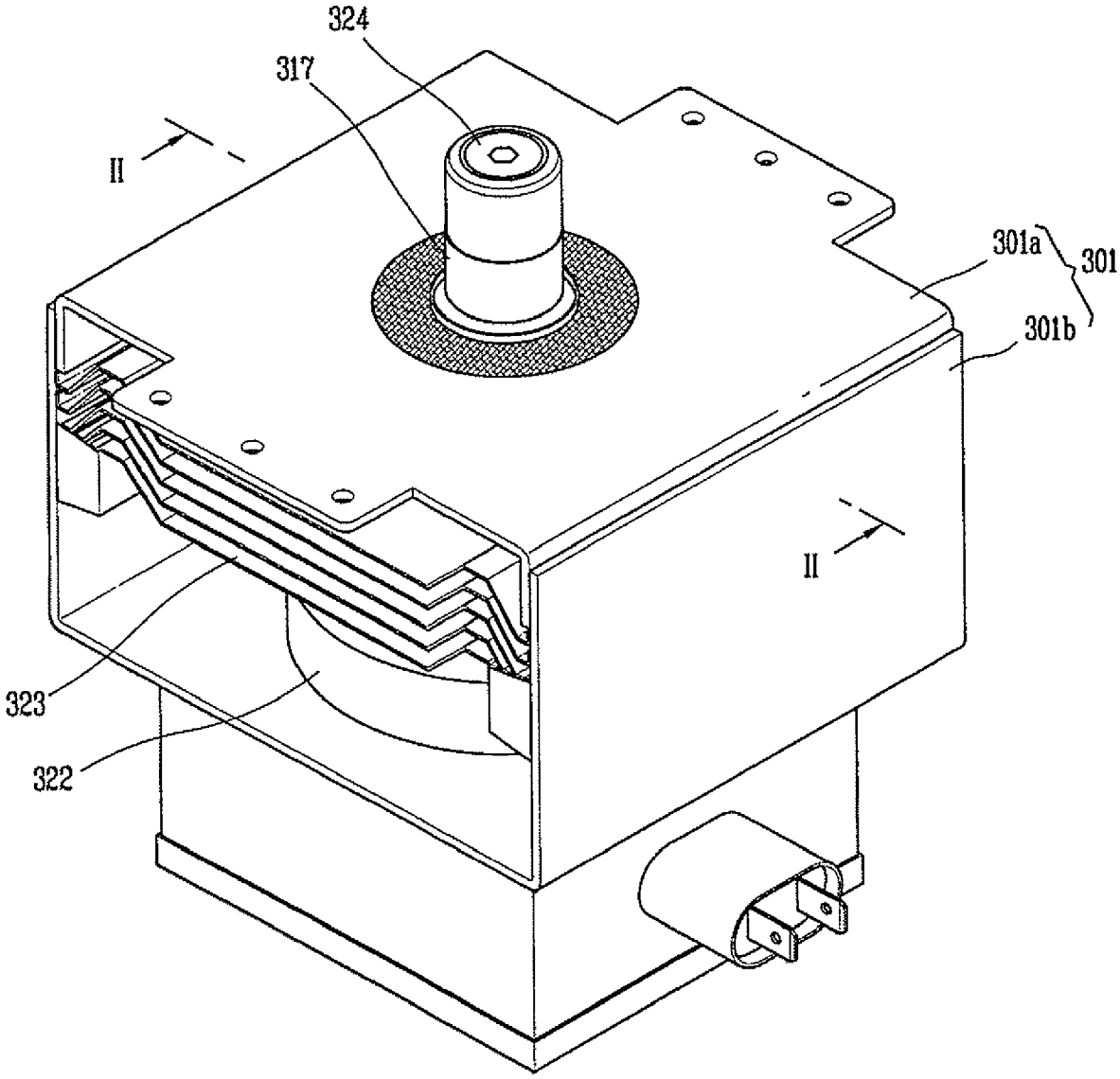
FIG. 1 is a perspective view illustrating a magnetron in accordance with the present invention.
Figure 2:
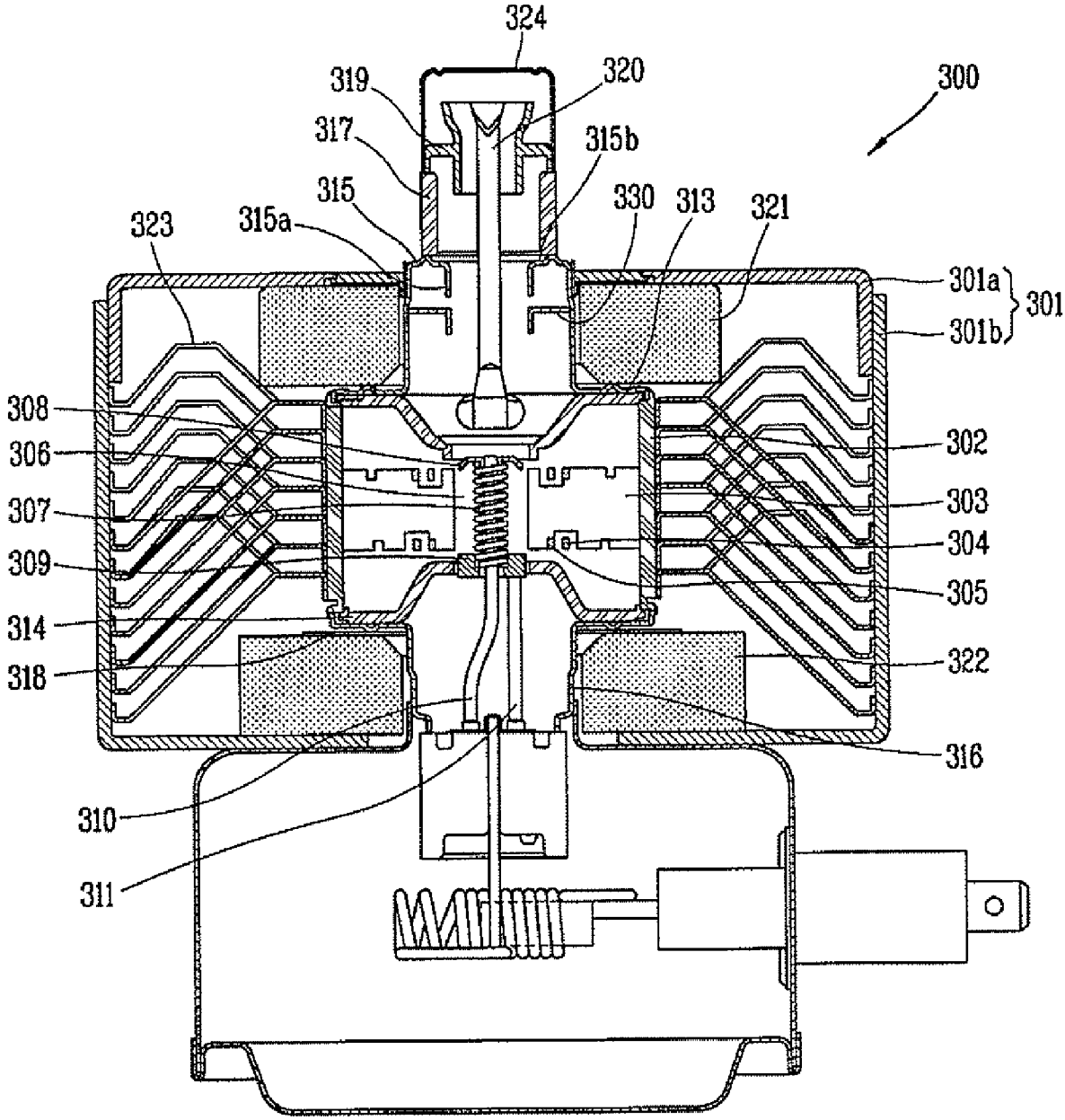
FIG. 2 is a cross-sectional view taken along line II-II of FIG. 1.
Figure 3:
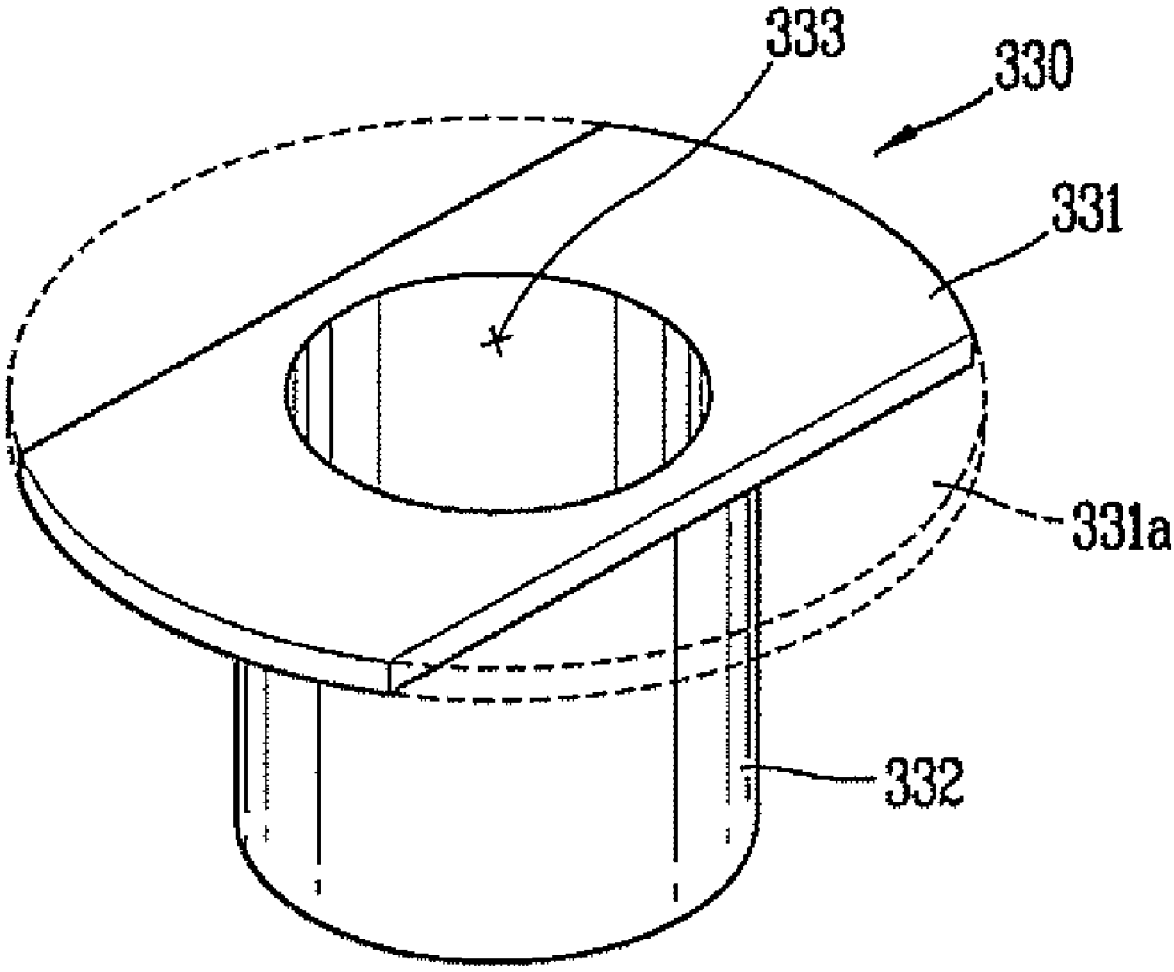
FIG. 3 is a perspective view illustrating the choke filter of FIG. 2.
Figure 4A:
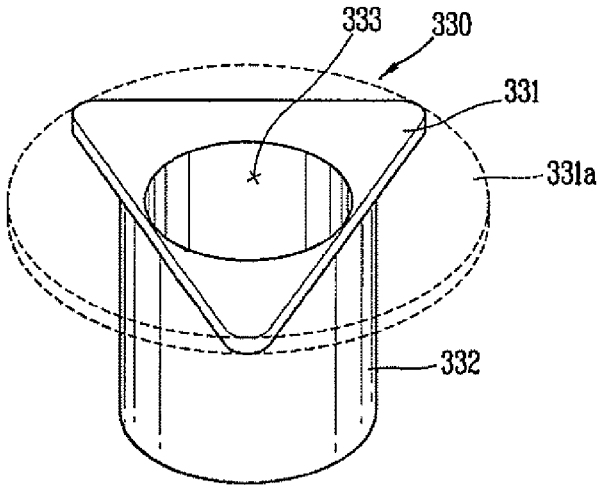
FIGS. 4A to 4F are perspective views illustrating various examples of the choke filter in accordance with the present invention.
Figure 4B:
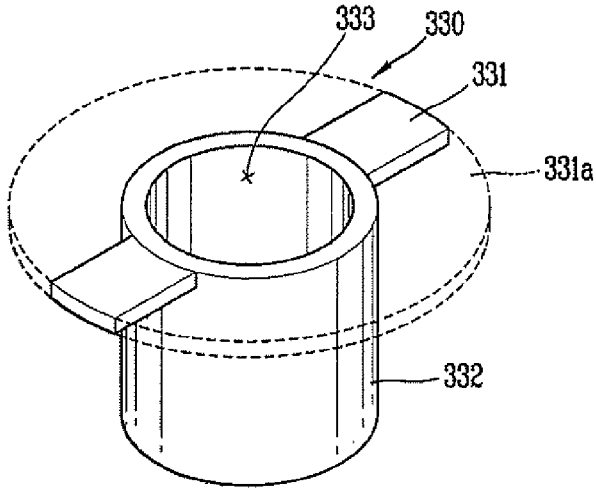
Figure 4C:
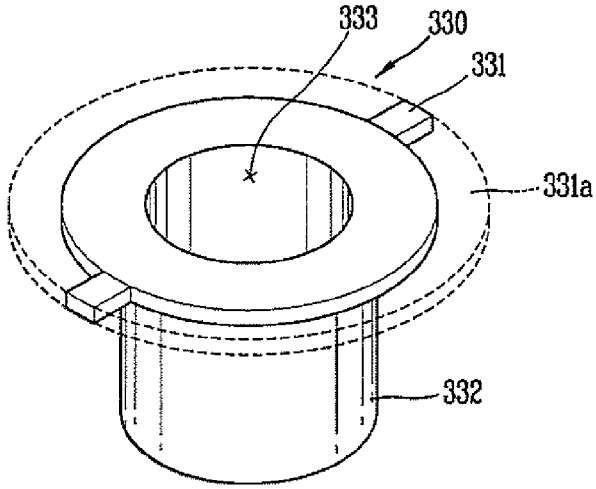
Figure 4D:
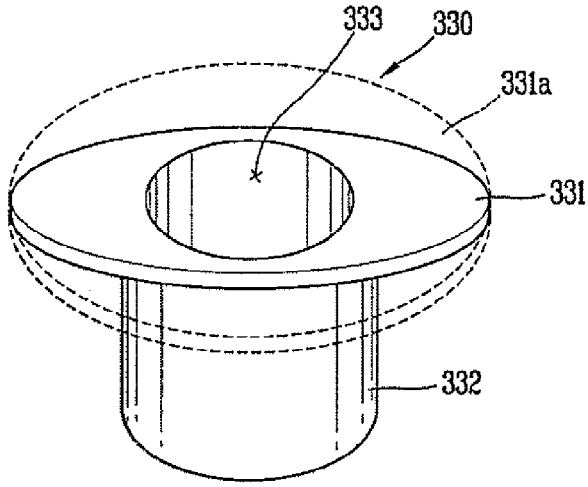
Figure 4E:
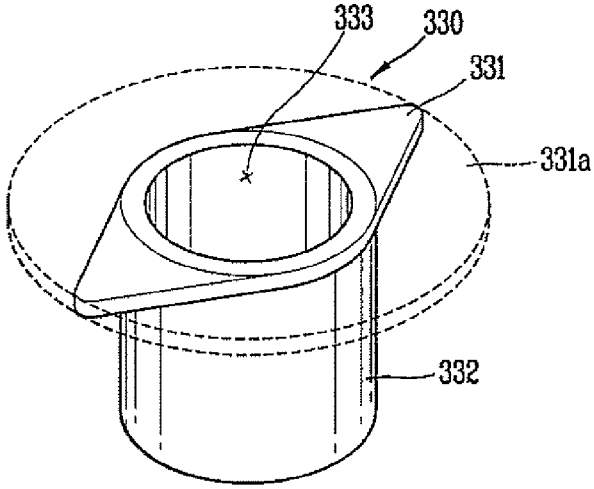
Figure 4F:
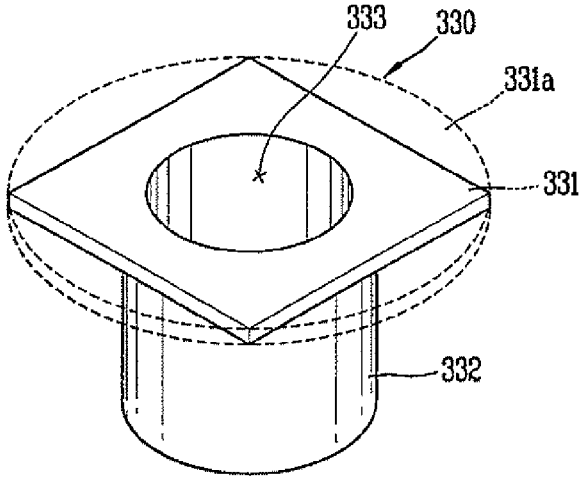
Figure 5:
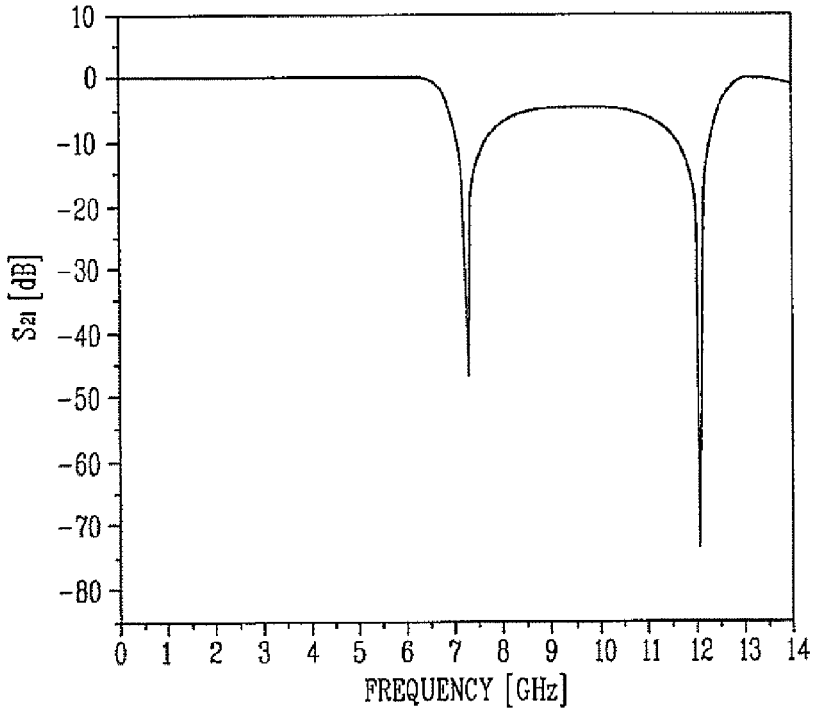
FIG. 5 is a graph showing a harmonic shielding effect of the magnetron in accordance with the present invention.
Figure 6:
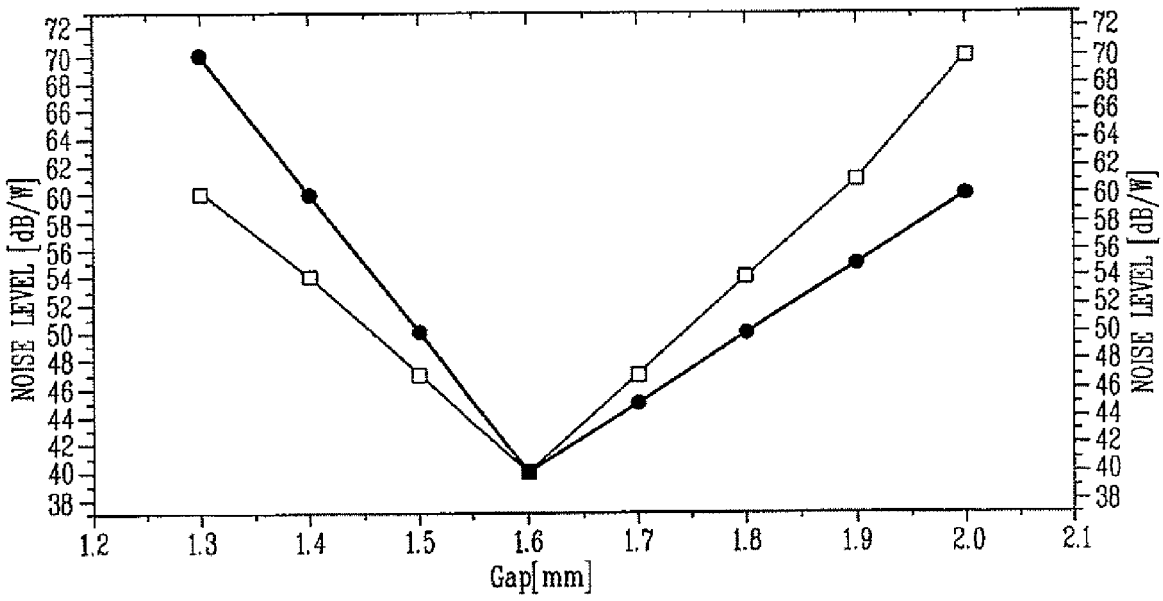
FIG. 6 is a graph showing a noise level by a gap between an A-seal and the choke filter in the magnetron in accordance with the present invention.

FIG. 1 is a perspective view illustrating the magnetron in accordance with the present invention, FIG. 2 is a cross-sectional view taken along line II-II of FIG. 1, FIG. 3 is a perspective view illustrating the choke filter of FIG. 2, FIGS. 4A to 4F are perspective views illustrating various examples of the choke filter in accordance with the present invention, FIG. 5 is a graph showing a harmonic shielding effect of the magnetron in accordance with the present invention, and FIG. 6 is a graph showing a noise level by a gap between the A-seal and the choke filter in the magnetron in accordance with the present invention.

Referring to FIGS. 1 and 2, the magnetron 300 (having the choke filter 330) includes a yoke 301 having an internal space formed, e.g., by coupling an upper yoke 301*a* and a lower yoke 301*b*, an upper magnet 321 and a lower magnet 322 housed in the internal space, and fixedly coupled respectively to the inner flat surfaces of the upper yoke 301*a* and the lower yoke 301*b* along the width direction of the yoke 301. Additionally, an anode cylinder 302 may be disposed (or provided) in a space between the upper magnet 321 and the lower magnet 322, for generating radio frequency energy, a funnel-shaped upper pole piece 313 and a funnel-shaped lower pole piece 314 disposed (or provided) at the upper and lower opening units of the anode cylinder 302, respectively, a cylindrical A-seal 315 disposed at the upper portion of the upper pole piece 313, for intercepting external leakage of a fifth harmonic, and the choke filter 330 having a generally planar disk 331 bonded to the inner circumferential surface of the A-seal 315, for intercepting external leakage of a third harmonic.

The upper yoke 301*a* and the lower yoke 301*b* are coupled to form, e.g., a rectangular side section. The cylindrical anode cylinder 302 is installed inside the yoke 301. A plurality of vanes 303 forming a hollow resonator for inducing harmonic elements are radially arranged toward the shaft center direction inside the anode cylinder 302.

Internal pressure equalization rings 304 and external pressure equalization rings 305 may be alternately coupled to the upper and lower portions of the front ends of the vanes 303, thereby forming an anode with the anode cylinder 302.

A filament 307 may be spirally wound around the center shaft of the anode cylinder 302 with an operation space 306 from the front ends of the vanes 303. The filament 307 may be made of a mixture of tungsten and thoria, which may be used to form a cathode. The cathode may be heated by an operation current supplied to the filament 307 (e.g., for emitting thermo-electrons).

A top shield 308 for intercepting upward emission of the thermo-electrons may be fixed to the top end of the filament 307, and a bottom shield 309 for intercepting downward emission of the thermo-electrons may be fixed to the bottom end of the filament 307. A center lead 310 made of molybdenum may be inserted into a through hole formed at the center of the bottom shield 309, and fixedly bonded to the bottom surface of the top shield 308. Also, a top end of a side lead 311 made of molybdenum may be bonded to the bottom surface of the bottom shield 309 with a predetermined interval from the center lead 310.

The funnel-shaped upper pole piece 313 and lower pole piece 314 made of a magnetic material may be coupled to the upper and lower opening units of the anode cylinder 302. The cylindrical A-seal 315 and F-seal 316 may be bonded to the upper portion of the upper pole piece 313 and the lower portion of the lower pole piece 314 by brazing, respectively, for preventing external leakage of the third harmonic elements.

The choke filter 330 may be disposed at the lower portion of the A-seal 315 along the height direction of the magnetron 300, for preventing external leakage of the fifth harmonic elements. The coupling slot 331*a* may be formed at one side of the choke filter 330. As shown in FIG. 6, the isolation gap between the A-seal 315 having the minimum noise and the choke filter 330 increases from about 1.2 mm to about 1.6 mm. As a result, the magnetron 300 can be easily assembled in a short time. That is, the planar disk 331 of the choke filter 330 may be axially spaced from a radially extending bottom surface 315*b* of the A-seal 315 to form a gap The choke filter 330 may have a generally flat disk 331 formed with a predetermined width and bonded to one side circumference of the A-seal 315, and a cylinder (or generally cylindrical end) 332 coaxially disposed with the disk 331, formed with a smaller diameter than that of the disk 331, and extended from the bottom surface of the disk 331 by a predetermined length along the thickness direction of the disk 331. A hollow hole 333 may be formed at the center portions of the disk 331 and the cylinder 332. Further, an inward protrusion 315*a* of the A-seal 315 may be axially aligned with the cylinder (or generally cylindrical end) of the choke filter. Additionally, the inward protrusion 315*a* of the A-seal 315 may be provided radially within the cylinder 332 of the choke filter The coupling slot may be formed at one side of the disk 331. For example, the coupling slot 331*a* may be formed by cutting one side of the disk unit 331, so that one side flat surface of the disk unit 331 cannot be bonded to the A-seal 315.

As illustrated in FIGS. 4A to 4F, the coupling slot 331*a* of the disk 331 is formed by cutting part of the flat surface of the disk 331 so that the disk 331 cannot contact the inner surface of the A-seal 315. Accordingly, the disk 331 can be formed in various shapes such as a polygonal shape including, e.g., a triangle or rectangle, and a curved elliptical shape according to the shape of the coupling slot 331*a*. However, it should be appreciated that any suitable arrangement for providing the coupling slot 331 may be employed.

An A-ceramic 317 for externally outputting a radio frequency and an F-ceramic for hot rolling may be bonded to the upper portion of the A-seal 315 and the lower portion of the F-seal 316 by brazing, respectively. An exhaust tube 319 may be bonded to the upper portion of the A-ceramic 317 by brazing. The top end of the exhaust tube 319 may be cut and bonded at the same time, for sealing up the inside of the anode cylinder 302 in a vacuum state.

An antenna 320 for outputting the radio frequency oscillated in the hollow resonator may be installed inside the A-seal 315. The bottom end of the antenna 320 may be connected to the vanes 303, and the top end thereof may be fixed to the inner top surface of the exhaust tube 319.

On the other hand, the upper magnet 321 and the lower magnet 322 may be coupled to the upper and lower portions of the anode cylinder 302 to contact the inner surface of the yoke 301, for generating magnetic fields with the upper pole piece 313 and the lower pole piece 314.

Cooling fins 323 may be installed between the inner circumference of the yoke 301 and the outer circumference of the anode cylinder 302. An antenna cap 324 for protecting the bonded portion of the exhaust tube 319 may be covered on the upper portion of the A-ceramic 317.

In the magnetron 300 described above, when external power is supplied to the center lead 310 and the side lead 311, the closed circuit comprised of the center lead 310, the filament 307, the top shield 308, the bottom shield 309 and the side lead 311 is formed, to supply an operation current to the filament 307. The filament 307 is heated by the operation current, thereby emitting the thermo-electrons, and electron group is formed by the thermo-electrons.

A strong electric field may be generated in the operation space 306 by a driving voltage supplied to the anode through the side lead 311. The magnetic fluxes generated by the upper magnet 321 and the lower magnet 322 are induced to the operation space 306 along the lower pole piece 314, and transferred to the upper pole piece 313 through the operation space 306. Therefore, a high magnetic field may be generated in the operation space 306.

Referring to FIG. 5, in the high magnetic field, the fifth harmonic may be coupled (or intercepted) by the A-seal 315, and thus may not be externally leaked, and the third harmonic may be coupled by the coupling slot 331*a*, and thus may not be externally leaked.

The thermo-electrons emitted from the surface of the high temperature filament 307 to the operation space 306 receive force in the vertical direction by the strong electric field existing in the operation space 306, spirally perform circular motion, and reach the vanes 303.

The electron group generated by the electron motion may interfere with the vanes 303 at a period of one divided by an inverse number of a multiple of the periodical oscillation radio frequency By this operation, inductance elements composed of the facing spaces of the vanes 303 and the anode cylinder 302 form a parallel resonance circuit on the circuit, thereby inducing the radio frequency from the vanes 303. The induced radio frequency may be externally emitted from the magnetron 300 through the antenna 320, for driving an electronic product such as an electrodeless illumination apparatus or a microwave oven.

It is further noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A magnetron, comprising:

a yoke having an internal space provided between first and second ends thereof;

a first magnet and a second magnet housed in the internal space, and fixedly coupled to the first and second ends, respectively, along a width direction of the yoke;

an anode cylinder that generates radio frequency energy provided in a space between the first magnet and the second magnet;

a funnel-shaped first pole piece and a funnel-shaped second pole piece disposed at the first and second openings of the anode cylinder, respectively;

a cylindrical A-seal provided proximate an upper end of the first pole piece, and configured to intercept external leakage of a fifth harmonic, wherein the cylindrical A-seal includes an inwardly bent end extending from a top end of the A-seal and extending downwardly in an axial direction; and a choke filter provided proximate a lower end of the A-seal along a height direction of the A-seal, and configured to intercept external leakage of a third harmonic.

2. The magnetron according to claim 1, wherein the choke filter comprises:

a disk having a diameter;

a cylinder having a generally cylindrical shape and extending from a bottom surface of the disk along a thickness direction of the disk; and a coupling slot formed at one side of the disk.

3. The magnetron according to claim 2, wherein the coupling slot is formed by cutting one side of the disk such that a generally flat edge of the disk is spaced from an inner circumferential surface of the A-seal.

4. The magnetron according to claim 3, wherein the disk has a generally polygonal shape.

5. The magnetron according to claim 3, wherein the disk is formed having a generally bent shape.

6. The magnetron according to claim 3, wherein the choke filter is spaced from a bottom surface of the A-seal thereby forming a gap therebtween.

7. The magnetron according to claim 6, wherein the isolation gap between the choke filter and the A-seal is about 1.6 mm.

8. A magnetron, comprising:

a yoke having an internal space;

a first magnet provided at one end of the internal space;

a second magnet provided at a second end of the internal space, wherein the second magnet is axially spaced from the first magnet;

an anode cylinder that generates radio frequency energy provided axially between the first and second magnets;

a first pole piece and a second pole piece provided proximate first and second openings of the anode cylinder, respectively;

a seal that intercepts external leakage, the seal having an inward protrusion extending axially towards the anode cylinder; and a choke filter that intercepts external leakage provided proximate the seals wherein the seal is configured to intercept external leakage of a third harmonic, and the choke filter is configured to intercept external leakage of a fifth harmonic.

9. The magnetron according to claim 8, wherein the seal is a cylindrical A-seal.

10. The magnetron according to claim 8, wherein the first and second pole pieces are generally funnel-shaped.

11. The magnetron according to claim 8, wherein the inward protrusion of the seal is axially aligned with the generally cylindrical end of the choke filter.

12. The magnetron according to claim 11, wherein the inward protrusion of the seal is provided radially within the generally cylindrical end of the choke filter.

13. The magnetron according to claim 8, wherein the choke filter comprises:

a generally planar disk configured to be received within an inner circumferential surface of the seal; and a generally cylindrical end extending from the bottom surface of the disk, and axially towards the anode cylinder.

14. The magnetron according to claim 13, wherein the planar disk of the choke filter is axially spaced from a radially extending bottom surface of the seal to form a gap.

15. The magnetron according to claim 14, wherein the gap is about 1.6 mm.

16. The magnetron according to claim 13, wherein at least a portion of a peripheral edge of the planar disk is spaced from the inner circumferential surface of the seal such that a slot is formed therebetween.

17. The magnetron according to claim 16, wherein the planar disk has a generally triangular shape.

18. The magnetron according to claim 16, wherein the planar disk has a generally rectangular shape.

19. The magnetron according to claim 16, wherein the planar disk has a generally elliptical shape.

* * * * *

UNITED STATES PATENT AND TRADEMARK OFFICE

CERTIFICATE OF CORRECTION

PATENT NO. : 7,511,251 B2
APPLICATION NO. : 11/613531
DATED : March 31, 2009
INVENTOR(S) : Seung-Won Baek et al.

It is certified that error appears in the above-identified patent and that said Letters Patent is hereby corrected as shown below:

At Column 6, line 43 (claim 8, line 16), “seals” should be -- seal, --.

Signed and Sealed this

Twenty-sixth Day of May, 2009

JOHN DOLL
*Acting Director of the United States Patent and Trademark Office*